US006287171B1

(12) United States Patent
Meloni

(10) Patent No.: US 6,287,171 B1
(45) Date of Patent: Sep. 11, 2001

(54) SYSTEM AND METHOD FOR DETECTING CMP ENDPOINT VIA DIRECT CHEMICAL MONITORING OF REACTIONS

(75) Inventor: Mark Meloni, Tempe, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/504,565

(22) Filed: Feb. 15, 2000

(51) Int. Cl.[7] ..... B24B 1/00

(52) U.S. Cl. ..... 451/5; 451/6; 451/7; 451/41; 451/287

(58) Field of Search ..... 451/5, 6, 7, 41, 451/285–289; 438/5, 692–693; 436/164

(56) References Cited

U.S. PATENT DOCUMENTS 5,036,015 * 7/1991 Sandhu et al. ..... 437/8
5,069,002 * 12/1991 Sandhu et al. ..... 451/5
5,196,353 * 3/1993 Sandhu et al. ..... 437/8
5,308,438 * 5/1994 Cote et al. ..... 156/636
5,399,234 * 3/1995 Yu et al. ..... 156/636
5,483,568 * 1/1996 Yano et al. ..... 378/44
5,637,031 * 6/1997 Chen ..... 451/41
5,637,185 6/1997 Murarka et al. .
5,858,799 1/1999 Yee et al. .

OTHER PUBLICATIONS

"Endpoint Detection for CMP" by Thomas Bibby and Karey Holland, Journal of Electronic Materials, vol. 27, No. 10, 1998, Special Issue Paper.

* cited by examiner

*Primary Examiner*—Derris H. Banks
*Assistant Examiner*—George Nguyen
(74) *Attorney, Agent, or Firm*—Snell & Wilmer, L.L.P.

(57) ABSTRACT

A system and method for detecting process endpoint in CMP is presented which monitors the progression of chemical activities that take place from the chemical reaction that occurs at the wafer surface during polishing. In order to monitor the progression of chemical activities taking place from the chemical reaction, a surface plasmon resonance sensor acts as a conducting surface which supports surface plasmon resonance.

12 Claims, 4 Drawing Sheets

SYSTEM AND METHOD FOR DETECTING CMP ENDPOINT VIA DIRECT CHEMICAL MONITORING OF REACTIONS

FIELD OF THE INVENTION

The present invention generally relates to a system and method for detecting a process endpoint on a workpiece during the planarization process in chemical mechanical polishing (CMP). More particularly, the present invention relates to a system and method for detecting process endpoint in CMP which monitors the progression of chemical activities that take place from the chemical reaction that occurs at the wafer surface during polishing, namely measuring surface plasmon resonance as produced by analytes in the slurry.

BACKGROUND OF THE INVENTION

High quality semiconductor wafers are required to produce reliable and high precision semiconductor devices. These high quality semiconductor wafers require an extremely flat surface on at least one side to ensure proper accuracy and performance of the microelectronic structures being created on the wafer surface. CMP is often used to remove material from the wafer surface to provide a relatively flat surface before building devices on the wafer surface. In addition, CMP is also used for interlevel dielectric planarization and metal polishing during the formation of the devices on the wafer surface. CMP is well known in the art and generally includes placing one side of the wafer in contact against a flat polishing surface, and moving the wafer and the polishing surface relative to one another. In addition, a slurry which includes abrasive particles and/or chemicals that react with the material on the wafer surface to dissolve the surface material may also be introduced between the wafer surface and the polishing pad to assist in removing a portion of the surface material. During the polishing or planarization process, the wafer is typically pressed against a rotating polishing pad. In addition, the wafer may also rotate and oscillate back and forth over the surface of the polishing pad to improve polishing effectiveness.

As previously stated, chemical mechanical polishing is performed on the wafer surface several times during the fabrication of a semiconductor device. Semiconductor manufacturers often measure the wafers before and during the formation of semiconductor devices. Manufacturers measure the wafers to ensure that the within wafer nonuniformity, the removal rate, and the removal rate stability are within process specifications. Off-line measurements tend to dominate the current form of measurement. As a result, semiconductor manufacturers can lose several hours per shift processing and measuring the monitor and product test wafers off-line. This can result in reducing, by almost one-half, the CMP equipment capacity.

Accordingly, a great deal of interest has been shown in in-line and/or in-situ measurements to assess CMP processes. In-line and/or in-situ measurements can assess the quality of the monitor and product wafers either immediately after (in-line) or during (in-situ) the polishing of the wafers and can thereby reduce or nearly eliminate the time typically required to test the wafers off-line. As a result, semiconductor manufacturers have been searching for a viable method of either monitoring the planarization of the surface or monitoring the removal rate of the dielectric form the surface of the wafer. In addition, manufacturers have also been searching for improved metal endpoint detection systems.

Multiple in-situ endpoint detection approaches have been proposed and tested for use in CMP including optical, electrical and acoustic sensing. Optical techniques used for detecting endpoint in CMP are primarily interferometry, reflectance, and spectral reflectivity . In U.S. Pat. No. 5,081,796, interferometry is used to measure a wafer which overhangs the edge of a platen and in relation to an unpatterned die. An alternative approach for endpoint detection using interferometry involves inserting small interferometers into a CMP carrier. In still another approach, an optical window is embedded in the rotating polishing pad and the platen to enable in-situ viewing of the surface being polished. Specular reflection from a test surface strikes a detector. The intensity of the reflected light changes markedly as the film thickness approaches zero. This method is described in U.S. Pat. No. 5,433,651. Further, in U.S. Pat. No. 5,196,353, an infrared camera positioned slightly below or with the top of the polishing pad senses the temperature at the surface of the wafer. Endpoint is detected by the temperature change which occurs when the friction changes in passing from one material to another.

Methods for detecting endpoint using electrical measurements include those that sense friction and those that do not. The electrical measurement methods that do not sense friction typically require electrical connections to the wafer during CMP or modifications to the platen and/or carrier assembly which affect the basic performance of the tool. The electrical measurement methods that do sense friction work particularly well in metal CMP since the CMP eventually leads to the exposure of the underlying interlevel dielectric layer which has a considerably different coefficient of friction than the metal. In contrast, planarization of the topography on an interlevel detection layer does not involve a transition to an underlying layer with a different coefficient of friction and therefore is not as amenable to this approach.

There have been several patents related to measuring changes in friction to detect endpoint. For example, U.S. Pat. Nos. 5,036,015 and 5,069,002 detect endpoint by monitoring changes in the motor current to infer the state of friction between the wafer and the pad. In this method, the motor current changes when one material having a given coefficient of friction is polishes through to an underlying material with a different coefficient of friction. Further, U.S. Pat. No. 5,308,438 monitors the motor current of the platen to track the power required to rotate the platen which is based on the coefficient of friction of the surface being polished. For example, when a surface having a low coefficient of friction such as metal is polished, the motor current is also low. The motor current then rises as the thickness of the metal film goes to zero and the polishing pad begins to polish the oxide.

The acoustic methods for detecting endpoint are based on the idea that the grinding action taking place during polishing generates an acoustic signal. These methods include monitoring the change in amplitude and frequency of spectral peaks as well as analyzing acoustic wave velocity.

Finally, a method for detecting endpoint by monitoring the electrochemical potential of the system is described in U.S. Pat. No. 5,637,185. In this method, the difference between a measurement electrode and a reference electrode are measured. The measurement electrode could be either the polishing surface or a probe inserted into the slurry near the wafer being polished while the reference electrode could be a saturated calomel electrode or a standard hydrogen electrode.

Although several approaches do exist for detecting in-situ endpoint in CMP, not all have become commercially viable and even those that are commercially viable have not proven to be 100% reliable. Accordingly, there is a need for additional systems and methods for determining in-situ endpoint in CMP. There is also a need for a system and method for detecting in-situ endpoint in CMP that reduces cost of ownership while increasing the reliability of endpoint detection.

SUMMARY OF THE INVENTION

The present invention provides a system and method for detecting process endpoints in CMP by monitoring the progression of chemical activities that take place from a chemical reaction that occurs at a wafer surface during polishing of the wafer with a slurry.

An exemplary embodiment of the system of the present invention includes a CMP apparatus for polishing the surface of a wafer using a slurry, and a means for measuring a surface plasmon resonance of the slurry near the wafer surface during CMP.

In accordance with an exemplary embodiment of the method of the present invention, a surface plasmon resonance sensor having a conducting layer is immersed in a slurry near a wafer carrier used in CMP where a surface of a wafer contained in the wafer carrier is polished using a polishing surface and a slurry, a light source is introduced in the surface plasmon resonance sensor, a surface plasmon resonance signal produced by the surface plasmon resonance sensor is measured in order to measure a reduction of a material reduced in a reduction oxidation reaction to determine an amount of free material in the slurry, and an endpoint for CMP is determined based on the amount of free material contained in the slurry.

In another aspect of the method of the present invention, the conducting layer excites a surface plasmon wave to produce an index of refraction at the surface of the conducting layer in order to minimize the effects of interspecies compound formation and/or overlapping stripping peaks when determining endpoint.

The present invention uses optical sensing techniques to produce a system and method for determining CMP endpoint from reactions taking place near a wafer surface during polishing having an increase in sensitivity, range, and/or speed over a system and method using electrochemical analysis.

BRIEF DESCRIPTION OF THE DRAWINGS

A more complete understanding of the present invention may be derived by referring to the detailed description and claims when considered in connection with the following drawing figures, wherein like numerals designate like elements, and:

DETAILED DESCRIPTION OF EXEMPLARY EMBODIMENTS

The system and method of the present invention are directed to determining process endpoints in CMP by monitoring the progression of chemical activities that take place from the chemical reaction that occurs at a wafer surface during polishing of the wafer with the slurry. The basic chemistry of the chemical reaction that takes place at the wafer surface during polishing can be represented as:

$$A(s)+B(l)+C(l)\rightarrow D(s)+E(l)+F(g)$$

where s is a solid, I is a liquid, and g is a gas.

Reduction oxidation (redox) reactions are those chemical reactions where the reactants are reduced (via electron flow) and oxidized. The typical reaction is the reduction of a metal into a metal oxide or metal hydroxide. These processes are known to occur for copper, aluminum, tungsten, and other metals commonly used in CMP. Direct measurement of the redox reaction allows for determination of the amount of free metal in the solution (slurry) and thereby permits determination of a polishing endpoint as the reaction rates change due to removal of the free metal from the surface of the wafer and its conversion into an oxide or hydroxide. Currently, redox reactions are the dominant mechanisms carried out in metal CMP at the wafer surface. Examples of redox reactions occurring at the wafer surface while polishing metals in CMP include:

$$Cu(s)+H_2O_2\rightarrow CuO+H_2O+O_2+H_2$$

$$Ta(s)+H_2O_2\rightarrow Ta_2O_5+H_2O+O_2+H_2$$

These chemical reactions represent the reduction in oxidation of copper and tantalum, respectively. In the present invention, these chemical reactions and the products of the reactions are monitored to determine the endpoint of the material being polished on the surface of the wafer. More particularly, the present invention involves a system and method which utilizes a sensor that can monitor the product of the redox reactions optically by measuring a physical property, such as the refractive index, of the redox reaction product. A single sensor probe monitors both the redox reaction and the products of the redox reaction.

Figure 1:
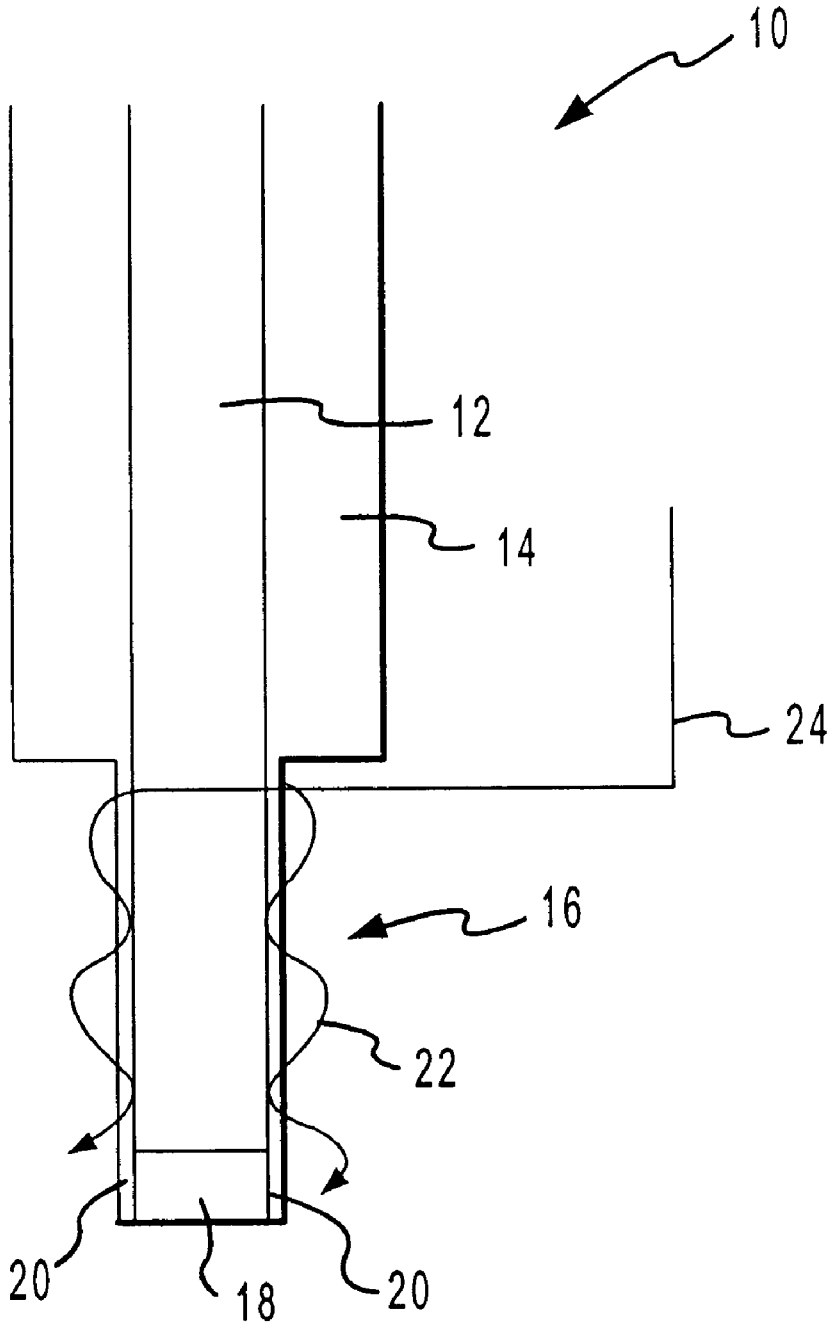
PRIOR ART FIG.1
FIG. 1 is a schematic view of a prior art embodiment of a surface plasmon resonance sensor which can be used in accordance with the system and method of the present invention.

FIG. 1 is a schematic view of a prior art embodiment of a single sensor, namely a surface plasmon resonance sensor shown in U.S. Pat. No. 5,858,799, which can be used in accordance with the system and method of the present invention, and which is herein incorporated by reference. The prior art surface plasmon resonance (SPR) sensor (10) includes a glass core (12) encompassed by a plastic layer (14). An amount of the plastic layer is removed from the tip (16) of the fiber and a thick metal mirror (18), for example a gold mirror, is deposited on the tip (16) in a thick enough layer to prevent it from supporting surface plasmon resonance. A sensing area (20) is then provided around the outside of the fiber which remains exposed by depositing a metal layer, such as a gold film, which supports surface plasmon resonance. The sensing area (20) supports the surface plasmon wave (SPW) and emits onto the sides of the fiber optic. A metal wire (22) is attached to the sensing area (20) of the SPR sensor (10) to provide electrical contact with a voltage source. During use, light is introduced into the fiber optic and the light travels down the fiber optic via total internal reflection. The light then hits the mirror (18) and reflects off the mirror (18). This reflected light is then monitored to measure the surface plasmon resonance occurring at the sensing area (20).

The sensing area (20) of the SPR sensor (10) comprises a layer of conducting or semi-conducting material. Preferably, gold is used for this conducting layer due to its high conductivity and stability. The sensing area (20) supports surface plasmon resonance and is the site of oxidation and reduction of redox-active analytes. The surface plasmon wave (SPW) is excited on the surface of the sensing area (20) by light incident in the wave guide, a three-dimensional structure which is constructed in such a manner that it confines optical energy, by allowing it to be transported from one point to another with minimum loss. The optical signal resulting from the SPR sensor is then used to determine the effect of index of refraction at the surface of the sensing area (2). The effect of index of refraction is a function of the optical properties of the reduced analyte, the optical properties of the supporting electrolyte, and the thickness of the reduced material at the surface of the sensing area.

The foregoing description of a prior art SPR sensor is used for exemplary purposes only. Those skilled in the art will appreciate that any number of configurations of the SPR sensor may be used in the system and method of the present invention to carry out their intended purpose in monitoring chemical reactions taking place at the wafer surface during CMP to determine endpoint.

Figure 2:
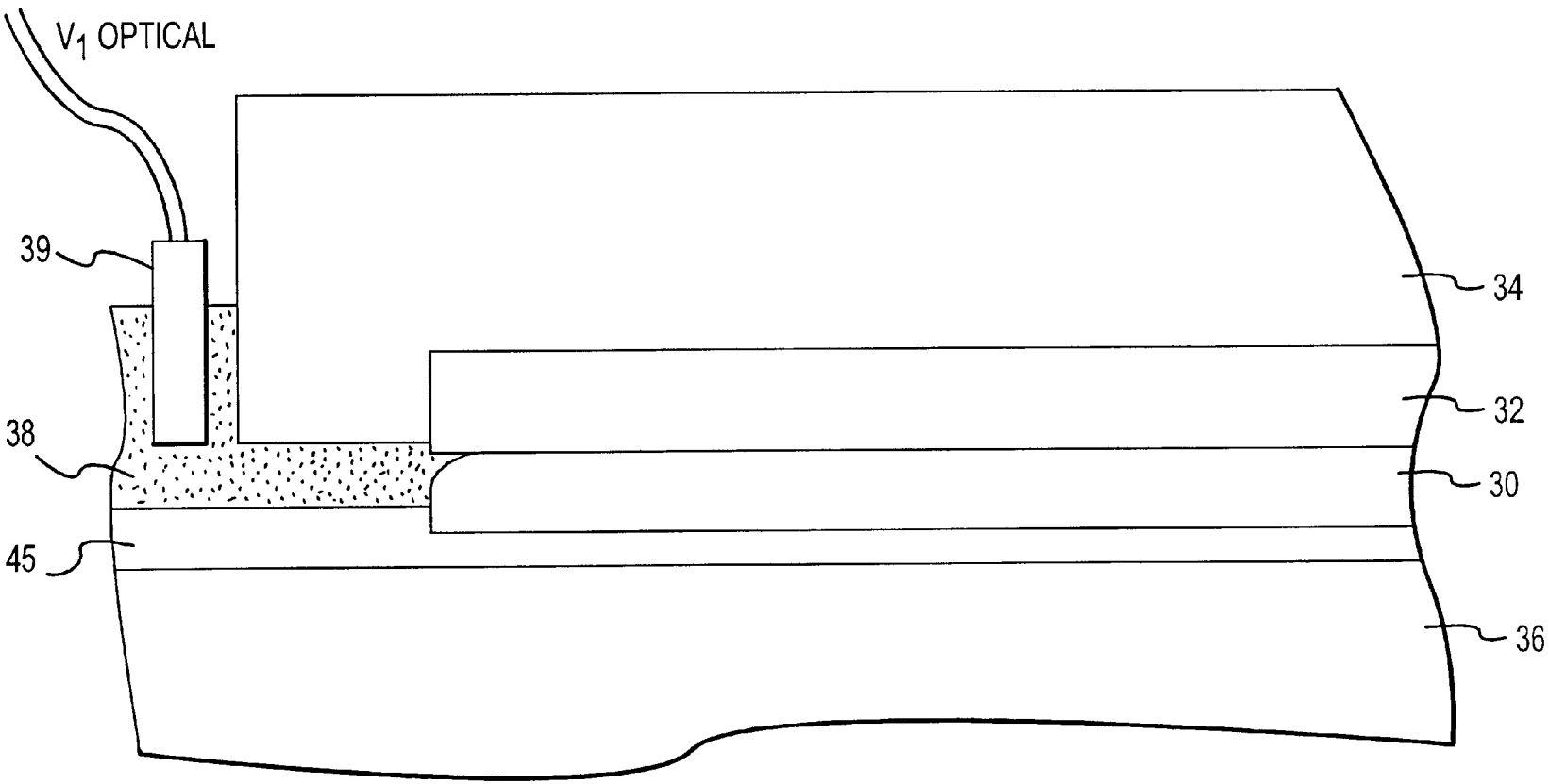
FIG. 2 is a partial schematic view of one exemplary embodiment of the system of the present invention for detecting CMP endpoint by measuring the chemical reactions taking place at a wafer surface during polishing.

Turning now to FIG. 2, there is shown a schematic view of one exemplary embodiment of the system of the present invention for detecting CMP endpoint by measuring the chemical reactions taking place at a wafer surface during polishing. A wafer (30) is retained against a pressure plate (32) in the wafer carrier (34) while the wafer is being polished against a polishing pad (45) seated on the platen (36). A slurry (38) is used during the CMP process and a SPR sensor (39) is immersed in the slurry (38) in order to monitor the chemical reactions and the creation of the products from the chemical reactions taking place at the surface of the wafer.

The SPR sensor (39) comprises a layer of conducting or semi-conducting material. However, it is preferable to use a conducting material for the sensing area of the SPR sensor. The sensing area of the SPR sensor supports surface plasmon resonance and is also the site of oxidation and reduction of redox-active analytes. The sensing area is preferably comprised of a metal wherein the metal preferably comprises, but is not limited to, gold, silver and titanium. The surface plasmon wave is excited on the surface of the sensing area by introducing in the SPR sensor which may comprise, for example, the base of a prism or the core of a waveguide. The light introduced into the SPR excites the surface plasmon wave on the surface of the sensing area by light incident in the waveguide, or on the base of the prism.

The SPR sensor itself may comprise a number of various configurations which allow for total internal reflection of light. For example, SPR sensors may include, but are not limited to, prisms (as referenced above), waveguides (as referenced above), and light pipes. The SPR sensor may be fabricated from any material that is transparent or semitransparent to the wavelength of light being used. Examples of these materials include, but are not limited to, glasses, crystals, semiconductors, plastics, or liquids confined by a rigid structure which has a lower index of refraction than the liquid.

Figure 3:
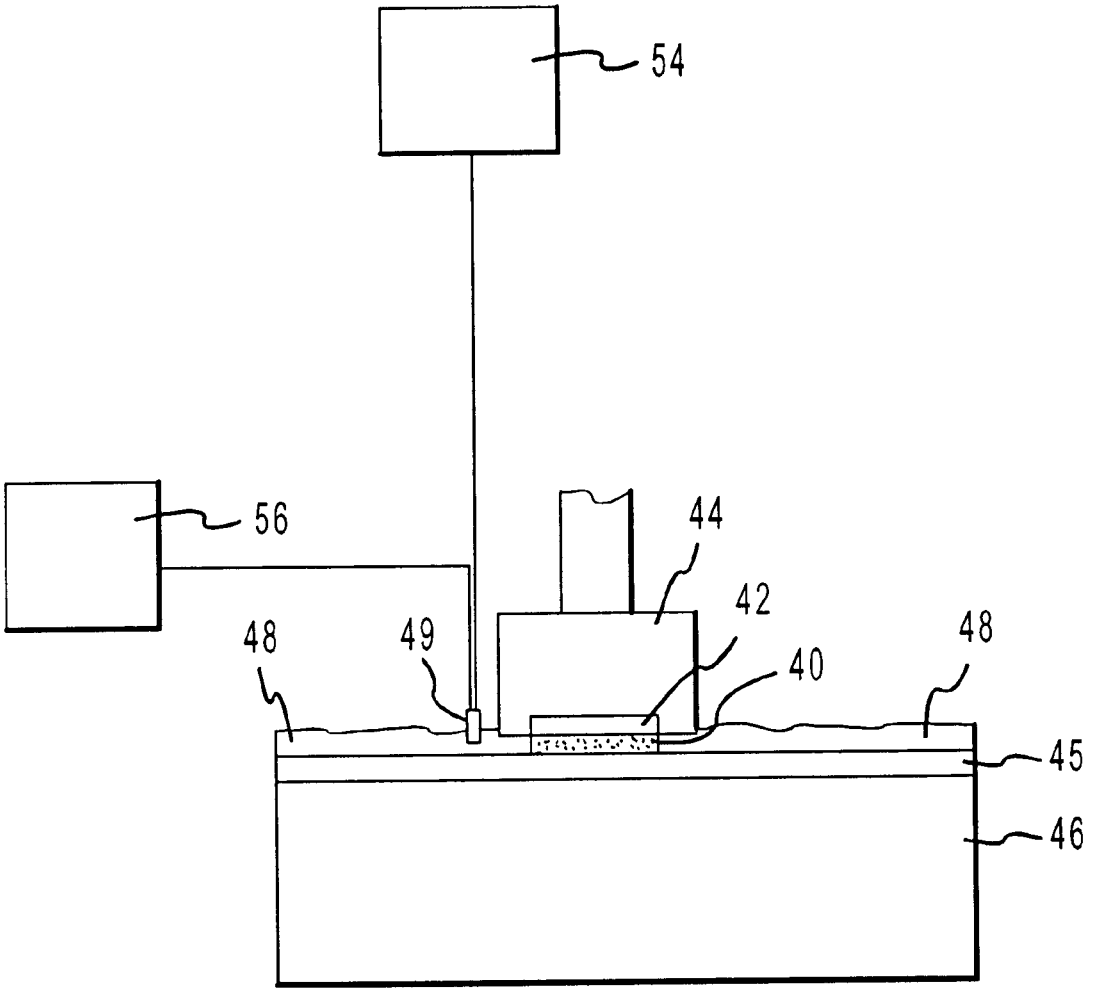
FIG. 3 is a schematic view of an exemplary embodiment of the complete system of the present invention for detecting CMP endpoint by measuring the chemical reactions taking place at a wafer surface during polishing.

A more complete schematic view of an exemplary embodiment of the system of the present invention for detecting CMP endpoint by measuring the chemical reactions taking place at a wafer surface during polishing is shown in FIG. 3. A wafer (40) is retained against a pressure plate (42) in a wafer carrier (44) during polishing. Also during polishing, a surface of the wafer (40) maintains contact with a polishing pad (45) which is secured to a platen (46). In addition, a slurry (48) is introduced between the surface of the wafer (40) being polished and the polishing pad (45). A SPR sensor (49) is immersed in the slurry (48) in the downstream flow of the slurry (48) near the wafer carrier (44). The SPR sensor (49) includes a conducting layer, a light source (54), and a detector (56).

The conducting layer of the SPR sensor (49) acts as a connecting surface which supports surface plasmon resonance. The surface of the conducting layer is used to excite a surface plasmon wave (SPW) whose optical properties can be measured to enhance the information about the chemical reaction taking place at the surface of the wafer. Particularly, the SPW, which is created by introducing a light source (54) into the SPR sensor (49) and detected by detector (56), provides information such as the effective index of refraction at the surface of the conducting layer as the analytes are being oxidized and/or reduced. This information can be used to minimize the effects of overlapping stripping peaks and interspecies compound formation as well as to determine the thickness of surface layers during measurements. The determination of optical properties of reaction products determined by the SPR sensor (49) can also provide information about the slurry (48), for example the quantity and types of natural oxidants contained in the slurry, such as oxygen or hydroxides. The formation of oxygen or hydroxides lead to measurably different optical properties.

Figure 4:
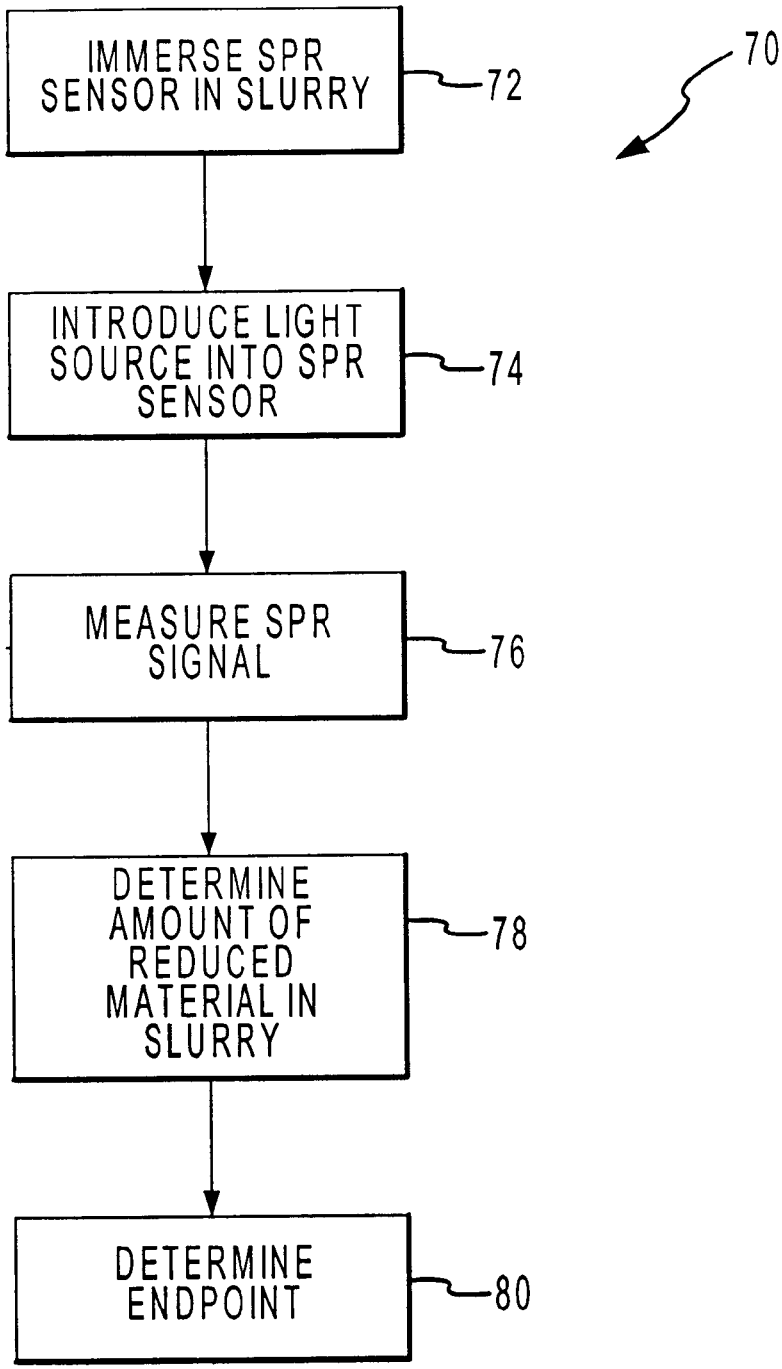
FIG. 4 is a flow diagram illustrating an exemplary embodiment of the method of the present invention for detecting CMP endpoint by measuring the chemical reactions taking place at a wafer surface during polishing.

FIG. 4 shows a flow diagram illustrating an exemplary embodiment of the method of the present invention (70) for detecting CMP endpoint by measuring the chemical reactions taking place at a wafer surface during polishing. First, in step 72, an SPR sensor is immersed in a slurry used during the CMP of a wafer surface.

Next, in step 74, a light source introduces light into the SPR sensor. When light is introduced into the SPR sensor from the light source in step 74, the SPR signal resulting from this step is measured in step 76. The amount of reduced material in the slurry resulting from an oxidation reduction reaction occurring at the wafer surface is then determined in step 78. Finally, in step 80, the endpoint for the CMP process is determined from the amount of reduced material contained in the slurry.

With the system and method of the present invention for determining endpoint, no process changes are necessary during the CMP process. In addition, the signal measured in the system of the present invention is nearly independent of polishing uniformity. The type of SPR sensor used in the method of the present invention will vary depending on the type of oxidation reduction reaction taking place at the wafer surface where the progression of the reaction is directly related to the polishing.

The system and method of the present invention uses optical sensing techniques to produce an overall more sensitive system and method for determining chemical reactions taking place at the surface of a wafer during CMP. Most electrochemical methods for determining CMP endpoint are insensitive or demand long integration types for good signal analysis. The system and method of the present invention removes those restrictions and SPR sensors used in accordance with the system and method of the present invention are constantly advancing in sensitivity, range, and/or speed.

It will be understood that the foregoing description is of exemplary embodiments of the invention and that the invention is not limited to the specific form shown or described herein. Various modifications may be made in the design, arrangement, and type of elements disclosed herein, as well as the steps of making and using the invention, without departing from the scope of the invention as expressed in the appended claims.

I claim:

1. A system for in-situ endpoint detection in CMP comprising:

a CMP apparatus for polishing a surface of a wafer contained in a wafer carrier wherein the wafer surface is polished using a polishing pad and a slurry; and means for measuring a surface plasmon resonance signal of said slurry near the wafer's surface during CMP.

2. The system of claim 1 wherein said means for measuring a surface plasmon resonance includes a surface plasmon resonance sensor having a conducting surface comprising metal.

3. The system of claim 2 wherein the conducting surface of said surface plasmon resonance sensor is immersed in said slurry near the wafer's surface during polishing.

4. The system of claim 2 wherein said means for measuring a surface plasmon resonance of the slurry includes a means for introducing light into the surface plasmon resonance sensor.

5. The system of claim 2 wherein said surface plasmon sensor comprises at least one of a prism, a waveguide, and a light pipe.

6. The system of claim 2 wherein said metal comprises at least one of gold, silver, and titanium.

7. The system of claim 1 wherein optical sensing techniques produce a system for determining chemical reactions taking place at the wafer surface during polishing, having an increase in at least one of sensitivity, range and speed over a system using electrochemical analysis.

8. A method for in-situ endpoint detection in CMP comprising the steps of:

polishing a surface of a wafer contained in a wafer carrier using a polishing surface and a slurry;

immersing a surface plasmon resonance sensor having a conducting layer in a slurry near said wafer carrier used in CMP;

introducing a light source into said surface plasmon resonance sensor;

measuring a surface plasmon resonance signal produced by said surface plasmon resonance sensor to measure a reduction of a metal to at least one of a metal oxide and metal hydroxide to determine an amount of free metal in said slurry; and determining an endpoint for CMP based on the amount of free metal contained in said slurry.

9. The method of claim 8 wherein said method uses optical sensing techniques to produce a method for determining chemical reactions taking place at the wafer surface during polishing having an increase in at least one of sensitivity, range and speed over a method using electrochemical analysis.

10. The method of claim 8 wherein said step of introducing light into the surface plasmon resonance sensor does not require a minimum integration period in order to perform good signal analysis.

11. A method for in-situ endpoint detection in CMP comprising the steps of:

polishing a surface of a wafer contained in a wafer carrier using a polishing surface and a slurry;

immersing a surface plasmon resonance sensor having a conducting layer in the slurry near said wafer carrier used in CMP;

introducing a light source into said surface plasmon resonance sensor;

measuring a surface plasmon resonance signal produced by said surface plasmon resonance sensor in response to a characteristic of the polishing slurry; and determining an endpoint for CMP based on analysis of the time evolution of the characteristic.

12. A method for in-situ endpoint detection in CMP comprising the steps of:

polishing a surface of a wafer contained in a wafer carrier using a polishing surface and a slurry;

immersing a surface plasmon resonance sensor having a conducting layer in the slurry near said wafer carrier used in CMP;

introducing a light source into said surface plasmon resonance sensor;

measuring a surface plasmon resonance signal produced by said surface plasmon resonance sensor in response to a chemical species in the slurry; and determining an endpoint for CMP based on analysis of the time evolution of the amount of the chemical species.

* * * * *